US008414465B2

(12) United States Patent
Totani

(10) Patent No.: US 8,414,465 B2
(45) Date of Patent: Apr. 9, 2013

(54) PLASTIC BAG MAKING APPARATUS

(75) Inventor: Mikio Totani, Kyoto (JP)

(73) Assignee: Totani Corporation, Kyoto (JP)

( * ) Notice: Subject to any disclaimer, the term of this patent is extended or adjusted under 35 U.S.C. 154(b) by 0 days.

(21) Appl. No.: 12/863,645

(22) PCT Filed: Nov. 13, 2008

(86) PCT No.: PCT/JP2008/070694

§ 371 (c)(1),
(2), (4) Date: Jul. 20, 2010

(87) PCT Pub. No.: WO2010/055571

PCT Pub. Date: May 20, 2010

(65) Prior Publication Data

US 2011/0212815 A1 Sep. 1, 2011

(51) Int. Cl.
*B31B 1/26* (2006.01)

(52) U.S. Cl.
USPC ..... 493/243; 493/162; 493/210; 493/246

(58) Field of Classification Search ..... 493/243, 493/246, 210, 214, 218, 223, 224, 162, 189, 493/198, 199
See application file for complete search history.

(56) References Cited

U.S. PATENT DOCUMENTS

| | | | | |
|---|---|---|---|---|
| 6,068,585 | A * | 5/2000 | Ouchi | 493/213 |
| 6,425,847 | B1 * | 7/2002 | Broenstrup | 493/231 |
| 6,561,963 | B2 * | 5/2003 | Totani | 493/218 |
| 6,740,020 | B2 * | 5/2004 | Horibe et al. | 493/218 |
| 6,860,844 | B1 * | 3/2005 | Ausnit | 493/212 |
| 7,044,184 | B2 * | 5/2006 | Totani | 156/378 |
| 7,331,917 | B2 * | 2/2008 | Totani | 493/244 |
| 7,497,624 | B2 * | 3/2009 | Totani | 383/120 |
| 7,775,957 | B2 * | 8/2010 | Totani | 493/210 |
| 2004/0258332 | A1 * | 12/2004 | Totani | 383/120 |
| 2005/0272583 | A1 * | 12/2005 | Totani | 493/162 |

FOREIGN PATENT DOCUMENTS

| | | |
|---|---|---|
| JP | 09183175 | 7/1997 |
| JP | 11091013 | 4/1999 |
| JP | 2000254984 | 9/2000 |
| JP | 2001158057 | 6/2001 |
| JP | 2002046197 | 2/2002 |
| JP | 2004010055 | 1/2004 |
| JP | 3534580 B2 * | 6/2004 |

* cited by examiner

*Primary Examiner* — M. Alexandra Elve
*Assistant Examiner* — Andrew M Tecco
(74) *Attorney, Agent, or Firm* — Kirschstein, et al.

(57) ABSTRACT

Provided is a bag-making machine for manufacturing a plastic bag with a body part and side gusset parts, in which when a bag having a long height is manufactured, it is not required to use a body member with a long width. Side gusset members (14) are folded in two and fed by a side gusset member supply mechanism (16). The side gusset members (14) are disposed in the longitudinal direction of a body member (11) so as to face each other at spaces therebetween in the lateral direction of the body member (11). Each of the side gusset members (14) is divided into predetermined lengths, and the divided side gusset members (14) are disposed at spaces therebetween in the longitudinal direction of the body member (11). The body member (11) and the side gusset members (14) are so heat-sealed by a vertical sealing device (26) in the longitudinal direction of the body member (11) as to form vertical seal parts (27).

6 Claims, 8 Drawing Sheets

[ Fig. 1]
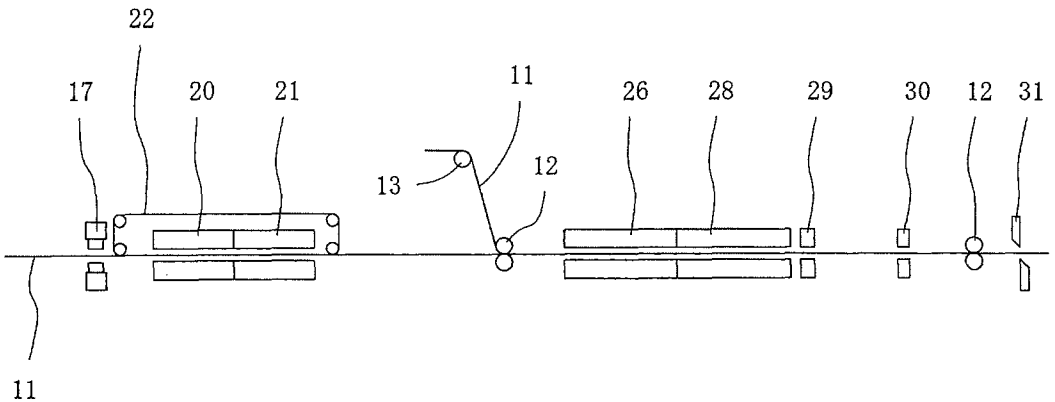

[ Fig. 2]
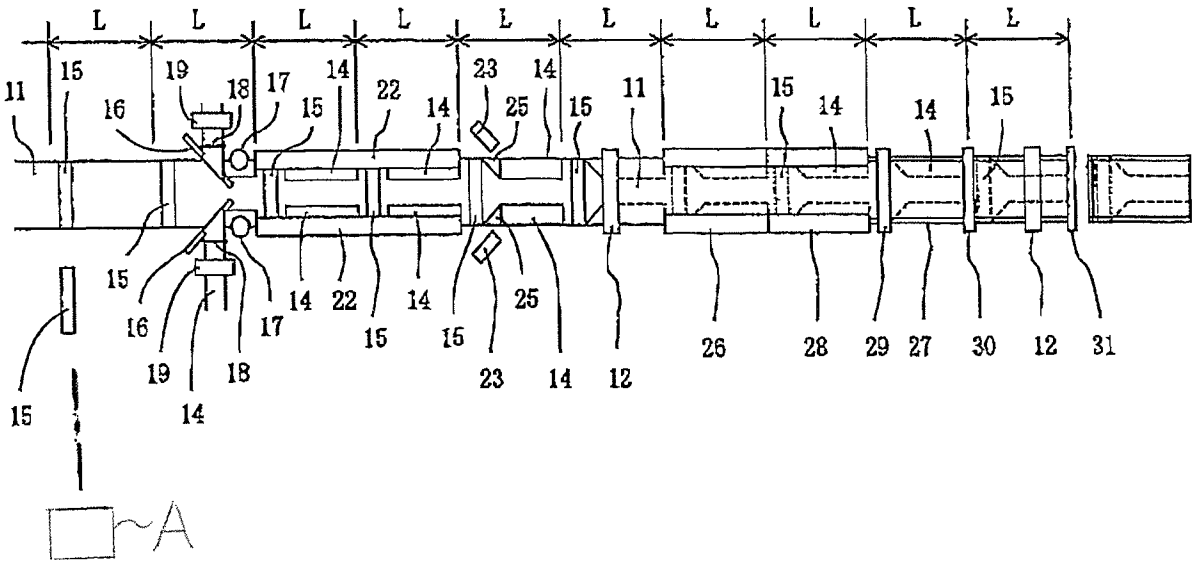

[ Fig. 3]
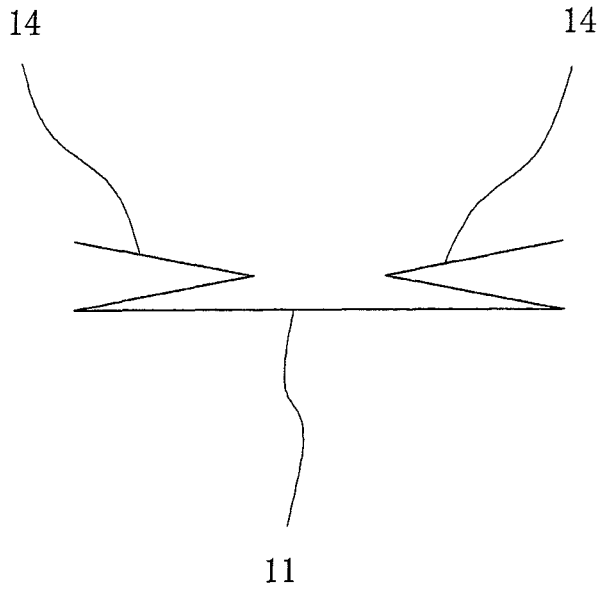
[Fig. 4]
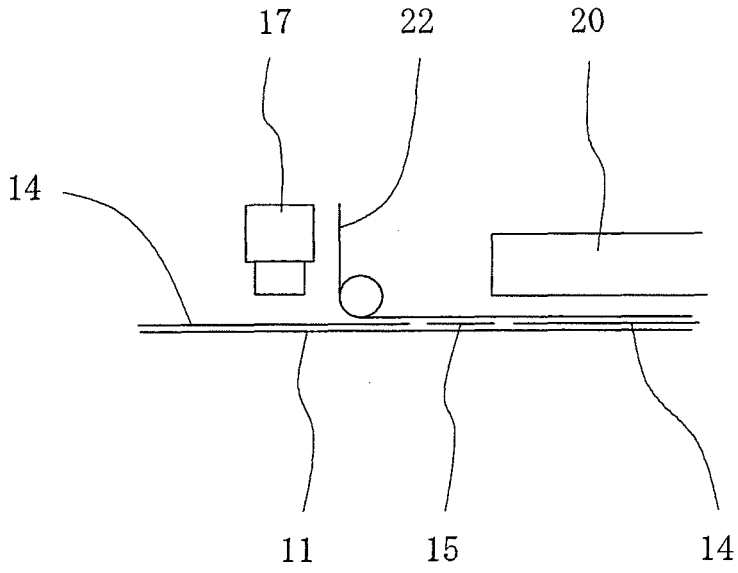

[Fig. 5]
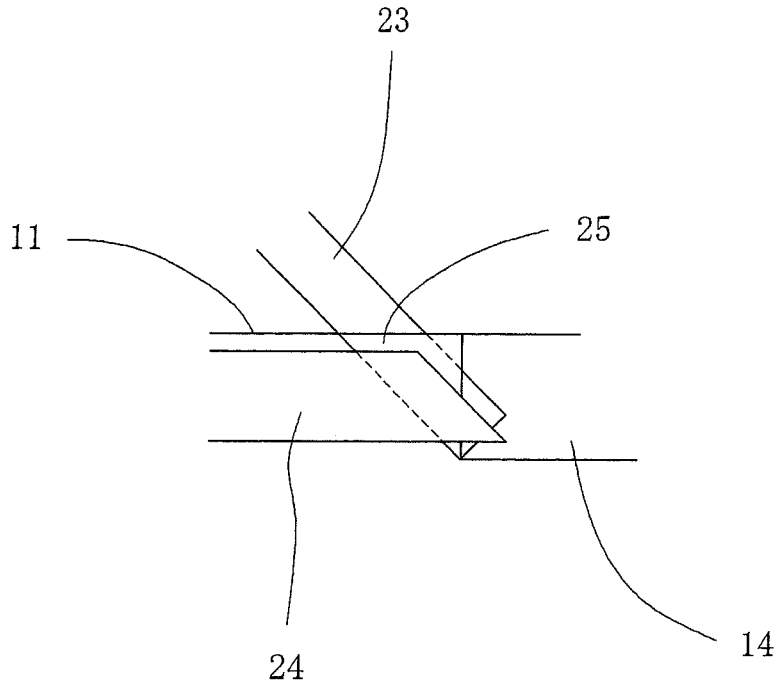

[Fig. 6]
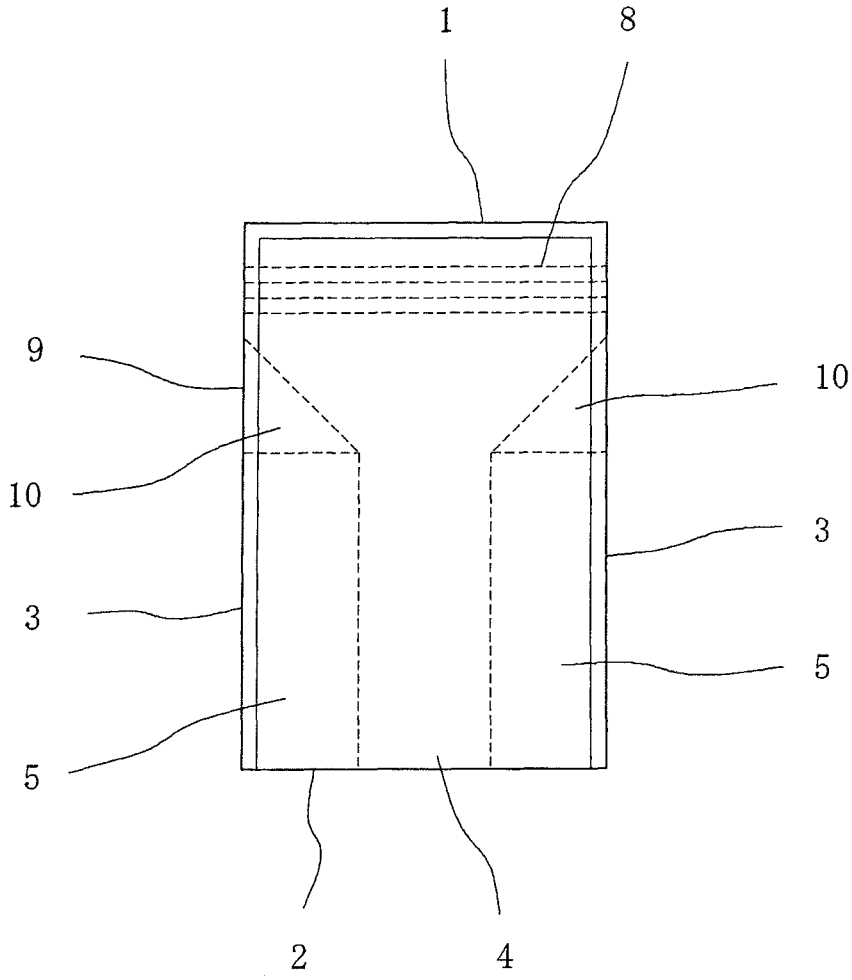

[Fig. 7]
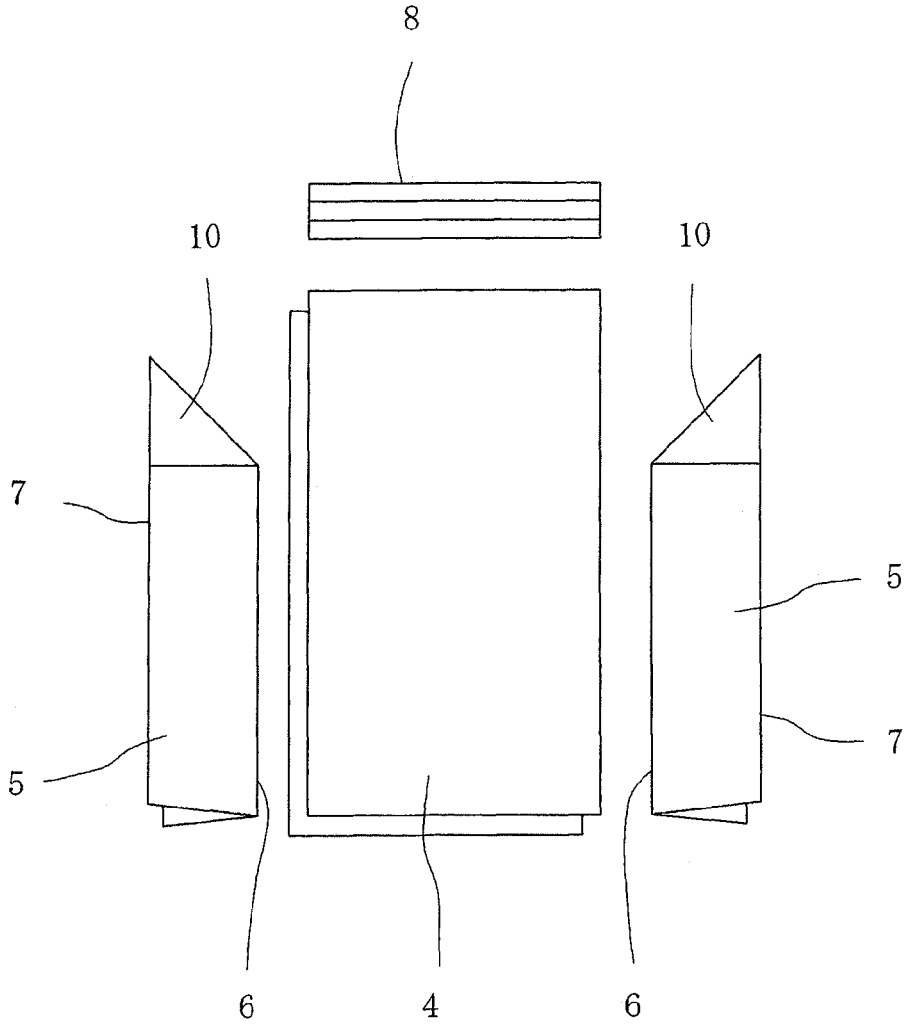

[Fig. 8]
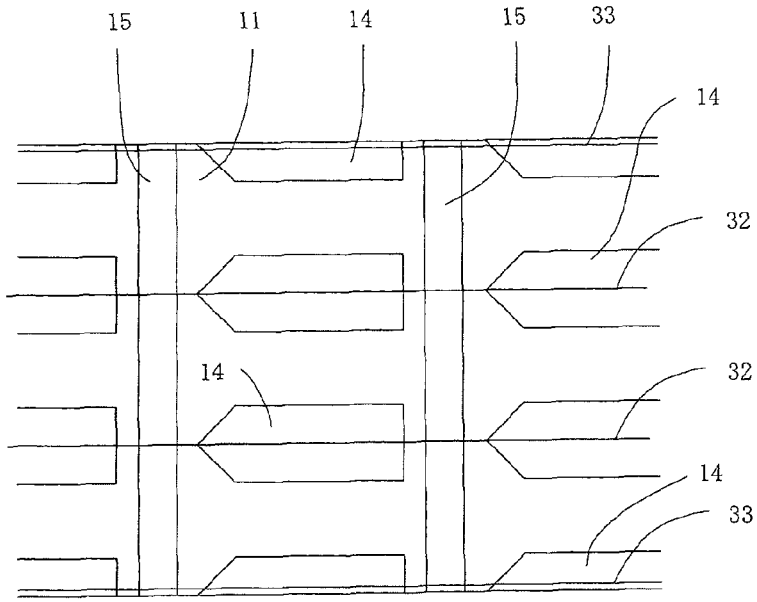
[Fig. 9]
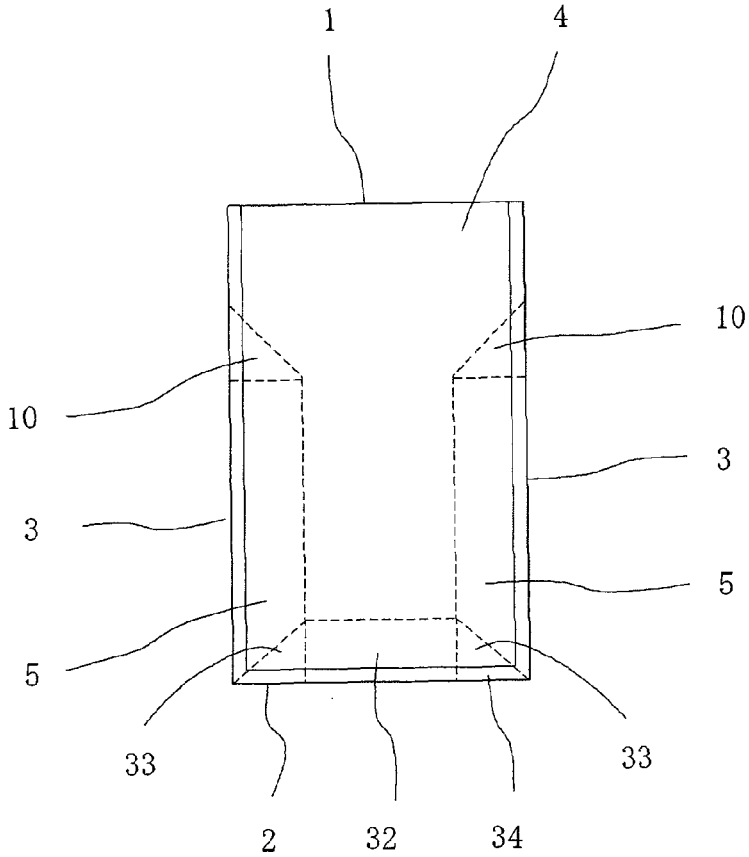

[Fig. 10]
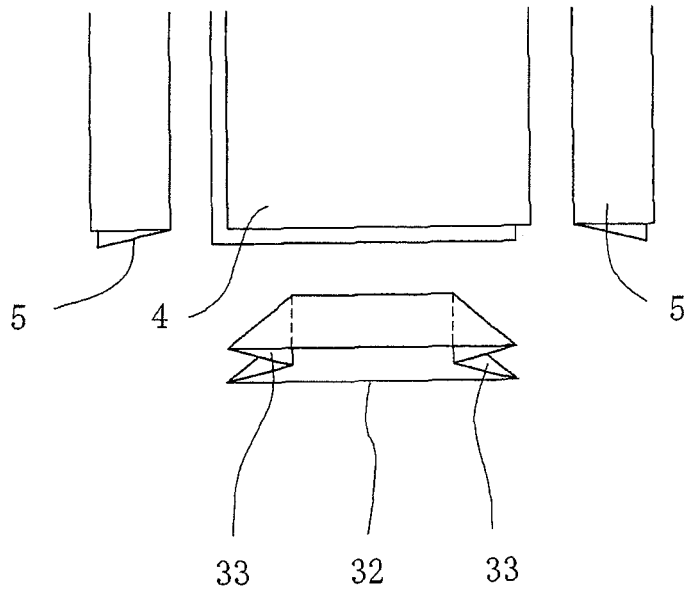
[Fig. 11]
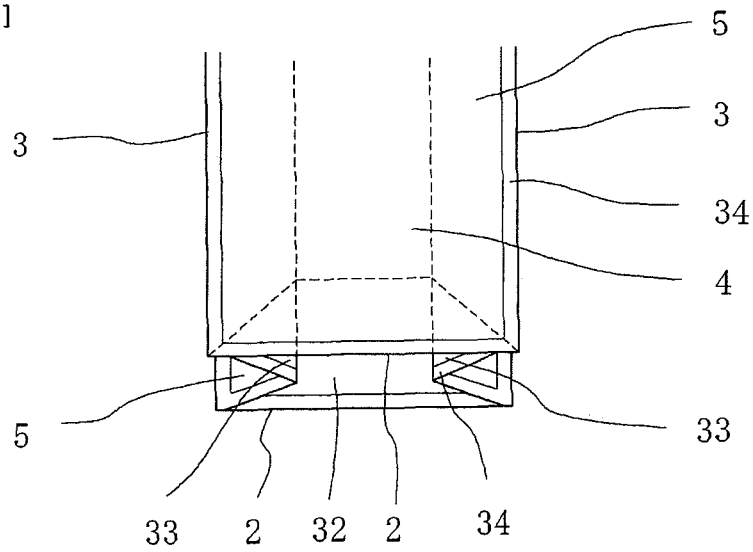

PLASTIC BAG MAKING APPARATUS

FIELD OF THE INVENTION

The invention relates to an apparatus for successively making plastic bags.

BACKGROUND

An apparatus has heretofore been developed and proposed to successively make plastic bags each of which includes side gusset portions and a zipper portion incorporated into superposed two layers of panel portion, as disclosed in Japanese Laid-Open Patent Publication No. 010055 of 2004. In the apparatus of the publication, webs of panel material are superposed into two layers and fed longitudinally thereof. A sheet of side gusset material is folded into halves and supplied to extend widthwise of the webs of panel material. A web of zipper material is supplied to extend longitudinally of the webs of panel material, the sheet of side gusset material and the web of zipper material being interposed between the layers of panel material. In addition, the layers of panel material are heat sealed with the web of zipper material longitudinally of the webs of panel material by longitudinal seal means after the sheet of side gusset material and the web of zipper material are interposed. The layers of panel material are then heat sealed with each other longitudinally of the webs of panel material by longitudinal seal means so that a longitudinal sealed portion can be formed longitudinally of the webs of panel material. The layers of panel material are further heat sealed with the sheet of side gusset material widthwise of the webs of panel material by cross seal means so that cross sealed portions can be formed widthwise of the webs of panel material. Accordingly, the plastic bag includes the side gusset portions formed by the sheets of side gusset material and the zipper portion formed by the web of zipper material, which are incorporated into the layers of panel portion formed by the webs of panel material. The plastic bag further includes a top edge formed by the longitudinal sealed portion and side edges formed by the cross sealed portions.

An apparatus has also been proposed to successively make plastic bags each of which includes side gusset portions and a bottom gusset portion, as disclosed in Japanese Laid-Open Patent Publication No. 254984 of 2000. In the apparatus of the publication, in addition to the sheet of side gusset material extending widthwise of the webs of panel material, a web of bottom gusset material extends longitudinally of the webs of panel material, the sheet of side gusset material and the web of bottom gusset material being interposed between the layers of panel material. The layers of panel material are heat sealed with the web of bottom gusset material longitudinally of the webs of panel material by longitudinal seal means so that longitudinal sealed portions can be formed longitudinally of the webs of panel material. The layers of panel material are heat sealed with the sheet of side gusset material widthwise of the webs of panel material by cross seal means so that cross sealed portions can be formed widthwise of the webs of panel material. Accordingly, the plastic bag includes the side gusset portions formed by the sheets of side gusset material and the bottom gusset portion formed by the web of bottom gusset material, which are incorporated into the layers of panel portion formed by the webs of panel material. The plastic bag further includes a bottom edge formed by the longitudinal sealed portions and side edges formed by the cross sealed portions.

By the way, the apparatus is recently requested to successively make plastic bags each of which has a tall structure and includes side gusset portions and a zipper or bottom gusset portion. However, in the apparatus of the publications, the sheets of side gusset material extend widthwise of the webs of panel material. In addition, the layers of panel material are heat sealed with the sheet of side gusset material widthwise of the webs of panel material by the cross seal means so that the cross sealed portions can be formed widthwise of the webs of panel material. The plastic bag includes the side edges formed by the cross sealed portions. The plastic bag therefore has a height in a direction which is not longitudinal but widthwise of the webs of panel material. In this connection, the webs of panel material have to be wide to successively make plastic bags each of which has a tall structure. However, it is difficult in the apparatus to use the webs of panel material which are wide. For example, in general, the webs of panel material are fed longitudinally thereof by feed rollers and through guide rollers. In this case, the feed and guide rollers are required to have lengths corresponding to the widths of webs of panel material which are wide, to be problematic in rigidity.

In addition, in the apparatus, a web of panel material may be supplied from a single roll and slit along the centerline thereof to be divided into two webs of panel material, the webs of panel material being then superposed into two layers, as described in Japanese Laid-Open Patent Publication No. 158057 of 2001. The web of panel material may have a pattern printed thereon before being slit. In this case, the webs of panel material can then be superposed into two layers after being slit without resulting in discrepancy in pattern between the layers of panel material. However, this method cannot be applied to the plastic bag having a tall structure by reason that the web of panel material is too wide before being slit. Accordingly, the webs of panel material have to be supplied from two rolls and superposed into two layers, resulting in difference in extension between the layers of panel material. The difference is accumulated gradually, resulting in discrepancy in pattern between the layers of panel material.

It is therefore an object of the invention to provide an apparatus which can successively make plastic bags each of which has a tall structure and includes side gusset portions incorporated into superposed layers of panel portion without using webs of panel material which are wide.

DISCLOSURE OF THE INVENTION

According to the invention, the apparatus includes panel material feeding means by which webs of panel material are superposed into two layers and fed longitudinally thereof. The apparatus further includes side gusset material supply means by which webs of side gusset material are folded into halves and supplied to extend longitudinally of the webs of panel material. The webs of side gusset material are spaced from and opposed to each other widthwise of the webs of panel material. The webs of side gusset material are divided into sheets of side gusset material each of which has a length. The sheets of side gusset material are spaced from each other longitudinally of the webs of panel material. The sheets of side gusset material are interposed between the layers of panel material. In addition, the apparatus includes longitudinal seal means by which the layers of panel material are heat sealed with the sheets of side gusset material longitudinally of the webs of panel material after the sheets of side gusset material are interposed so that longitudinal sealed portions can be formed longitudinally of the webs of panel material. The plastic bag includes the side gusset portions formed by the sheets of side gusset material and incorporated into the layers of panel portion formed by the webs of panel material. The plastic bag further includes side edges formed by the longitudinal sealed portions.

In a preferred embodiment, the webs of side gusset material are supplied onto one of the webs of panel material before the webs of panel material are superposed into two layers. The sheets of side gusset material are interposed between the layers of panel material when the webs of panel material are superposed into two layers.

The webs of side gusset material are divided into the sheets of side gusset material after being supplied.

The webs of side gusset material may be divided into the sheets of side gusset material before being supplied. The webs of side gusset material are then supplied onto one of the webs of panel material in the form of the sheets of side gusset material.

Furthermore, the apparatus includes zipper supply means by which a sheet of zipper material is supplied onto one of the webs of panel material to extend widthwise of the webs of panel material so that the sheet of zipper material can be disposed between the sheets of side gusset material. The sheet of zipper material is interposed between the layers of panel material when the webs of panel material are superposed into two layers. The apparatus further includes cross seal means by which the layers of panel material are heat sealed with the sheet of zipper material widthwise of the webs of panel material after the sheets of side gusset material and the sheet of zipper material are interposed. The plastic bag includes a zipper portion formed by the sheet of zipper material.

In addition, the apparatus includes cross seal means by which the layers of panel material are heat sealed with each other widthwise of the webs of panel material after the sheets of side gusset material and the sheet of zipper material are interposed so that a cross sealed portion can be formed widthwise of the webs of panel material. The plastic bag includes a top edge formed by the cross sealed portion.

The apparatus may includes bottom gusset material supply means by which a sheet of bottom gusset material is supplied and interposed between the layers of panel material to extend widthwise of the webs of panel material so that the sheet of bottom gusset material can be combined with the sheets of side gusset material. The apparatus further includes cross seal means by which the layers of panel material are heat sealed with the sheet of bottom gusset material widthwise of the webs of panel material after the sheets of side gusset material and the sheet of bottom gusset material are interposed so that cross sealed portions can be formed widthwise of the webs of panel material. The plastic bag includes a bottom gusset portion formed by the sheet of bottom gusset material and a bottom edge formed by the cross sealed portions.

Furthermore, the apparatus includes a cutter by which the layers of panel material are cut widthwise of the webs of panel material after being heat sealed.

BRIEF DESCRIPTION OF THE DRAWINGS

FIG. 1 is a side view of a preferred embodiment of the invention.

FIG. 2 is a plan view of the apparatus of FIG. 1.

FIG. 3 is a sectional view of the web of panel material and the webs of side gusset material of FIG. 1.

FIG. 4 is an enlarged view of the relative arrangement between the web of side gusset material and the Teflon (registered trade mark) sheet of FIG. 1.

FIG. 5 is an enlarged view of the relative arrangement between the web of side gusset material, the guide plate and the spatula of FIG. 2.

FIG. 6 is an elevational view of a plastic bag obtained by the apparatus of FIG. 1.

FIG. 7 is an explosive view of the plastic bag of FIG. 6.

FIG. 8 is a plan view of another embodiment.

FIG. 9 is an elevetional view of another plastic bag.

FIG. 10 is an explosive view of the plastic bag of FIG. 9.

FIG. 11 is a perspective view of the plastic bag of FIG. 9.

BEST MODE TO CARRY OUT THE INVENTION

Turning now to the drawings, FIG. 1 illustrates an apparatus for successively making plastic bags, according to the invention, each of which has a rectangular and tall structure and includes a top edge 1, a bottom edge 2 and side edges 3, as shown in FIG. 6. The plastic bag further includes superposed layers of panel portion 4. In addition, the plastic bag includes side gusset portions 5 incorporated into the layers of panel portion 4 and extending along the side edges 3 of the plastic bag, as in the case of plastic bag of Japanese Laid-Open Patent Publication No. 010055 of 2004. Each of the side gusset portions 5 is folded into halves and interposed between the layers of panel portion 4. The side gusset portion 5 therefore has a folded inner edge 6 and open outer edges 7, as shown in FIG. 7. The plastic bag further includes a zipper portion 8 extending along the top edge 1 of plastic bag and interposed between the layers of panel portion 4. The layers of panel portion 4 are heat sealed with the side gusset portions 5 and heat sealed with each other so that heat sealed portions 9 can be formed along the side edges 3 and top edge 1 of the plastic bag. The layers of panel portion 4 are further heat sealed with the zipper portion 8. The zipper portion 8 may be called a fastener portion and has been used generally in itself. It includes a male member formed integrally with a tape and fitted into a female member which is also formed integrally with a tape. The layers of panel portion 4 are heat sealed with the tapes of male and female members respectively.

In the plastic bag, each of the layers of panel portion 4 and the side gusset portions 5 comprises a laminate film composed of a base material and a sealant. The layers of panel portion 4 have inner surfaces formed by the sealant and outer surfaces formed by the base material. The side gusset portions 5 have outer surfaces formed by the sealant and inner surfaces formed by the base portion when being folded into halves, as also in the case of plastic bag of Japanese Laid-Open Patent Publication No. 010055 of 2004.

In the plastic bag, each of the side gusset portions 5 has opposite end portions one of which is folded obliquely along a folded line as it is folded into halves at a position near the zipper portion 8. A triangular flap 10 is therefore formed by the end portion to be shaped into a triangle having a hypotenuse formed by the folded line. The triangle has an apex formed by an intersection between the end edge of the side gusset portion 5 and the folded inner edge 6. The layers of panel portion 4, the side gusset portion 5 and the triangular flap 10 are heat sealed respectively along the side edge 3 of the plastic bag. The layers of panel portion 4 and the side gusset portion 5 can therefore be closed to each other with a sealing strength enough to be free of leakage from the end portion of the side gusset portion 5, as also in the case of plastic bag of Japanese Laid-Open Patent Publication No. 010055 of 2004.

In order to successively make plastic bags of FIG. 6, the apparatus includes panel material feeding means by which webs of panel material 11 are superposed into two layers and fed longitudinally thereof. The panel material feeding means comprises feeding rollers 12. One of the webs of panel material 11 is directed to the feeding rollers 12. The other web of panel material 11 is directed to the feeding rollers 12 through a guide roller 13 so that the webs of panel material 11 can be superposed into two layers. The feeding rollers 12 are rotated intermittently at a number of revolutions so that the webs of panel material 11 can be fed longitudinally thereof and intermittently for a length L, as shown in FIG. 2. The plastic bag has a height corresponding to the length L.

The apparatus further includes side gusset material supply means by which webs of side gusset material 14 are folded into halves and supplied to extend longitudinally of the webs of panel material 11. The webs of side gusset material 14 are spaced from and opposed to each other widthwise of the webs of panel material 11 and interposed between the layers of panel material 11. The side gusset material supply means includes side gusset material dividing means by which the webs of side gusset material 14 are divided into sheets of side gusset material each of which has a length. The sheets of side gusset material 14 are spaced from each other longitudinally of the webs of panel material 11.

In the embodiment, a pair of webs of side gusset material 14 are folded previously and supplied onto one of the webs of panel material 11 before the webs of panel material 11 are superposed into two layers. The webs of side gusset material 14 are divided into the sheets of side gusset material after the webs of side gusset material 14 are supplied. In addition, the apparatus includes zipper supply means by which a sheet of zipper material 15 is supplied onto one of the webs of panel material 11 to extend widthwise of the webs of panel material 11 so that the sheet of zipper material 15 can be disposed between the sheets of side gusset material 14.

For example, the webs of panel material 11 comprise upper and lower webs superposed into two layers. The webs of side gusset material 14 are directed widthwise of the lower web of panel material 11 on the opposite sides of the lower web of panel material 11. The side gusset material supply means comprises a pair of turn bars 16 disposed and fixed above the lower web of panel material 11 so that the webs of side gusset material 14 are engaged with the turn bars 16. The turn bars 16 are inclined at an angle of 45° with respect to the webs of side gusset material 14. The webs of side gusset material 14 are therefore guided by the turn bars 16 to be changed in direction at an angle of 90° and then supplied and put on the lower web of panel material 11 to extend longitudinally of the webs of panel material 11. The webs of side gusset material 14 are disposed at positions corresponding to the side edges of the webs of panel material 11, to extend along the side edges of the webs of panel material 11. It should therefore be understood that the webs of side gusset material 14 are spaced from and opposed to each other widthwise of the webs of panel material 11. The webs of side gusset material 14 are disposed at the positions to have folded inner edges, as shown in FIG. 3.

The side gusset dividing means includes point seal means 17 by which the webs of side gusset material 14 and the web of panel material 11 are heat sealed or ultrasonic sealed with and temporarily fixed to each other at positions adjacent to the side edges of the web of panel material 11 whenever the webs of panel material 11 are fed intermittently and after the webs of side gusset material 14 are supplied. The webs of side gusset material 14 are therefore then pulled and fed by the web of panel material 11 when the webs of panel material 11 are fed.

In addition, the side gusset dividing means includes perforating means 18 by which perforations are formed in the webs of side gusset material 14 when the webs of side gusset material 14 are directed widthwise of the lower web of panel material 11 and whenever the webs of panel material 11 are fed intermittently. The perforating means 18 comprises Thomson blades extending widthwise of the webs of side gusset material 14. The Thomson blades are lowered by drive means to be pressed against the webs of side gusset material 14 so that the perforation can be formed widthwise of the webs of side gusset material 14. The perforating means may comprise rotary knives moved widthwise of the webs of side gusset material 14 so that the perforations can be formed widthwise of the webs of side gusset material 14.

Furthermore, the side gusset dividing means includes brake means 19 by which brake forces are applied to the webs of side gusset material 14 after the webs of side gusset material 14 are pulled and fed by the web of panel material 11 to pass through the positions of the point seal means 17. For example, the brake means 19 includes pinch rollers between which the webs of side gusset material 14 are sandwiched when the webs of side gusset material 14 are fed. The brake forces are then applied to the pinch rollers and the webs of the side gusset material 14 to stop the webs of side gusset material 14. The webs of side gusset material 14 are therefore torn off along the perforations. The webs of side gusset material 14 and the web of panel material 11 are then heat sealed or ultrasonic sealed again by the point seal means 17. The perforations are also formed again so that the webs of side gusset material 14 can be divided into the sheets of side gusset material which are spaced from each other. The apparatus may be arranged not to stop but to decelerate the webs of side gusset material 14 so that the webs of side gusset material 14 can be torn off and divided by the difference in speed.

In addition, longitudinal seal means 20 and cooling means 21 are disposed downstream of the point seal means 17. The sheets of side gusset material 14 and the web of panel material 11 are heat sealed or ultrasonic sealed with and temporally fixed to each other by the longitudinal seal means 20 and then cooled by the cooling means 21 at the positions corresponding to the side edges of the web of panel material 11 whenever the webs of panel material 11 are fed intermittently. Each of the longitudinal seal means 20 comprises upper and lower seal bars. Each of the cooling means 21 comprises upper and lower cooling bars. The upper seal and cooling bars are covered and surrounded with an endless Teflon (registered trade mark) sheet 22 to keep the upper seal and cooling bars from adhering to the sheet of side gusset material 14. The Teflon (registered trade mark) sheet 22 is moved and circulated by friction of the sheet of side gusset material 14. The Teflon (registered trade mark) sheet 22 may be moved and circulated forcibly. In addition, the web of side gusset material 14 includes a front end portion positioned between the Teflon (registered trade mark) sheet 22 and the web of panel material 11 when being torn off along the perforation, as shown in FIG. 4. Accordingly, the web of side gusset material 14 is then guided by the Teflon (registered trade mark) sheet 22 to be fed smoothly when being pulled by the web of panel material 11 after the web of side gusset material 14 and the web of panel material 11 are temporally fixed to each other by the point seal means 17.

The apparatus further includes zipper supply means or zipper supplier A by which a sheet of zipper material 15 is supplied and put onto one of the webs of panel material 11 to extend widthwise of the webs of panel material 11, whenever the webs of panel material 11 are fed intermittently. The zipper supply means comprises an auto hand by which the sheet of zipper material 15 is supplied onto the lower web of panel material 11. The sheet of zipper material 15 and the web of panel material 11 may be heat sealed or ultrasonic sealed with and temporality fixed to each other by heat seal or ultrasonic seal means when the sheet of zipper material 15 is supplied. The sheet of zipper material 15 and the web of panel material 11 may be temporally fixed to each other by hot melt or part coat adhesives. The sheet of zipper material 15 is then fed by the web of panel material 11, the web of side gusset material 14 being torn off along the perforation to be divided into the sheets of side gusset material, so that the sheet of zipper material 15 can be disposed between the sheets of side gusset material 14.

The sheet of zipper material 15 and the web of panel material 11 are then heat sealed or ultrasonic sealed with and temporally fixed to each other by the longitudinal seal means 20 when the sheets of side gusset material 14 and the web of panel material 11 are heat sealed or ultrasonic sealed with and temporally fixed to each other. Guide plates 23 are then put on the sheets of side gusset material 14 to hold the sheets of side gusset material 14 down whenever the webs of panel material 11 are fed intermittently, as shown in FIG. 5. In addition, spatulas 24 are inserted between the sheets of side gusset material 14 and the web of panel material 11, the rear or front end portions of the sheets of side gusset material 14 being lifted and folded by the spatulas 24 and along guide plates 23, so that triangular flaps 25 can be formed by the rear or front end portions of the sheets of side gusset material 14, as in the case of that of Japanese Laid-Open Patent Publication No. 10055 of 2004.

The sheets of side gusset material 14 are then interposed between the layers of panel material 11 when the webs of panel material 11 are superposed into two layers. The sheet of zipper material 15 is also interposed between the layers of panel material 11.

The layers of panel material 11 are then heat sealed with the sheets of side gusset material 14 longitudinally of the webs of panel material 11 by longitudinal heat seal means 26 after the sheets of side gusset material 14 and the sheet of zipper material 15 are interposed and whenever the webs of panel material 11 are fed intermittently so that longitudinal sealed portions 27 can be formed longitudinally of the webs of panel material 11. In addition, the layers of panel material 11 are heat sealed with each other and with the sheet of zipper material 15 between the sheets of side gusset material 14 by the longitudinal heat seal means 26. The longitudinal sealed portions 27 are cooled longitudinally of the webs of panel material 11 by cooling means 28 whenever the webs of panel material 11 are fed intermittently. The layers of panel material 11 are then heat sealed with the sheet of zipper material 15 widthwise of the webs of panel material 11 by cross seal means 29 whenever the webs of panel material 11 are fed intermittently. The layers of panel material 11 are then heat sealed with each other widthwise of the webs of panel material 11 by cross seal means 30 whenever the webs of panel material 11 are fed intermittently, so that a cross sealed portion can be formed widthwise of the webs of panel material 11.

The longitudinal seal means 26 may have a length two times as much as the length L for which the webs of panel material 11 are fed intermittently so that the layers of panel material 11 can be heat sealed with the sheets of side gusset material 14 twice. The cooling means 28 may have a length two times as much as the length L so that the longitudinal sealed portions 27 can be cooled twice. Two cross seal means 29 may be spaced from each other at a distance corresponding to the length L so that the layers of panel material 11 can be heat sealed with the sheet of zipper material 15 twice. Two cross seal means 30 may be spaced from each other at a distance corresponding to the length L so that the layers of panel material 11 can be heat sealed with each other twice.

The apparatus further includes a cutter 31 by which the layers of panel material 11 are cut widthwise of the webs of panel material 11 after being heat sealed and whenever the webs of panel material 11 are fed intermittently, at a position corresponding to the cross sealed portion.

Accordingly, the plastic bag includes the side gusset portions 5 formed by the sheets of side gusset material 14, the zipper portion 8 formed by the sheet of zipper material 15 and the triangular flap 10 formed by the triangular flap 25, which are incorporated into the layers of panel portion 4 formed by the webs of panel material 11. In addition, the plastic bag includes the side edges 3 formed by the longitudinal sealed portions 27 and the top edge 1 formed by the cross sealed portion.

In the apparatus, the webs of side gusset material 14 extend longitudinally of the webs of panel material 11, as described previously. The layers of panel material 11 are then heat sealed with the webs of side gusset material 14 longitudinally of the webs of panel material 11 by the longitudinal heat seal means 26 so that the longitudinal sealed portions 27 can be formed longitudinally of the webs of panel material 11. The plastic bag includes the side edges 3 formed by the longitudinal sealed portions 27. The plastic bag therefore has a height in a direction which is longitudinal of the webs of panel material 11. As a result, the apparatus can successively make the plastic bags each of which has a tall structure and includes side gusset portions 5 without using webs of panel material which are wide. The feeding rollers 12 and the guide rollers 13 are merely required to have lengths corresponding to the widths of the webs of panel material 11, not to be problematic in rigidity.

In addition, a web of panel material can be supplied from a single roll and slit along the centerline thereof to be divided into two webs of panel material, the webs of panel material being then superposed into two layers, as in the case of the webs of panel material of Japanese Laid-Open Patent Publication No. 158057 of 2001, by reason that the web of panel material is not too wide. A pattern can be printed on the web of panel material before the web of panel material is slit and divided. The webs of panel material can therefore be superposed into two layers without resulting in discrepancy in pattern between the layers of panel material.

Furthermore, the webs of side gusset material 14 are divided into the sheets of side gusset material which are spaced from each other longitudinally of the webs of panel material 11, as described previously. The sheet of zipper material 15 can therefore be disposed between the sheets of side gusset material 14. As a result, the layers of panel material 11 can be heat sealed with the sheets of side gusset material 14 and the sheet of zipper material 15 without resulting in interference between the sheets of side gusset material 14 and the sheet of zipper material 15. In addition, the layers of panel material 11, the sheet of side gusset material 14 and the triangular flap 25 can be heat sealed respectively with a sealing strength enough to be free of leakage, after the flap 25 is formed by using the guide plate 23 and the spatula 24.

The web of side gusset material 14 is folded into halves, as described previously, to have open outer edges which may spread out when the web of side gusset material 14 is supplied. In this connection, the outer edges may be closed with part coat adhesives when the web of side gusset material 14 is folded into halves, not to spread out.

In addition, the webs of side gusset material 14 may be divided into the sheets of side gusset material not after being supplied but before being supplied. The webs of side gusset material 14 are then supplied onto and temporally fixed to one of the webs of panel material 11 in the form of the sheets of side gusset material. The webs of side gusset material 14 may be supplied onto one of the webs of panel material 11 after triangular flaps 25 are formed by the rear or front end portions of the sheets of side gusset material 14 at folding stations.

More than the pair of webs of side gusset material 14 may be supplied onto one of the webs of panel material 11 and spaced from and opposed to each other widthwise of the webs of panel material 11, as shown in FIG. 8. The webs of side gusset material 14 may have a double width, which is previously folded into halves on the opposite sides of the longitudinal centerline to be superposed into two layers, as in the case of the apparatus of Japanese Laid-Open Patent Publication No. 10055 of 2004. In this case, the layers of panel material 11 are cut by the cutter 31 after the webs of panel material 11, the sheets of side gusset material 14 and the sheets of zipper material 15 are slit along a slit line 32, to make two or more plastic bags at the same time. The webs of panel material 11, the sheets of side gusset material 14 and the sheets of zipper material 15 may be trimmed along trimming lines 33.

The apparatus can be arranged to successively make plastic bags of FIG. 9. The plastic bag has also a rectangular and tall structure and includes the same side gusset portions 5 as those of FIG. 6 incorporated into the layers of panel portion 4. In addition, the plastic bag includes the top edge 1 but not includes the zipper portion 8. The top edge 1 and the triangular flap 10 are therefore spaced from each other. In addition, the plastic bag includes a bottom gusset portion 32 extending along the bottom edge 2 of the plastic bag, folded into halves, superposed into two layers and interposed between the layers of panel portion 1. The bottom gusset portion 32 has opposite end portions by which auxiliary gusset portions 33 are formed, as shown in FIG. 10. The auxiliary gusset portions 33 are folded at an angle of 45° and into halves and interposed between the layers of bottom gusset portion 32. The auxiliary gusset portions 33 are interposed between the layers of panel portion 4 and the side gusset portion 5 along with the bottom gusset portion 32, as shown in FIG. 11. The layers of panel portion 4 are heat sealed with the side gusset portion 5 and with the bottom gusset portion 32 and heat sealed with each other between the top edge 1 and the triangular flap 10 so that heat sealed portions 34 can be formed along the side edges 3 and the bottom edge 2 of the plastic bag. The layers of auxiliary gusset portion 33 are heat sealed with the side gusset portion 5 so that heat sealed portions 34 can be formed along the bottom edge 2 of the plastic bag.

In order to successively make plastic bags of FIG. 9, the apparatus should include bottom gusset material supply means by which a sheet of bottom gusset material is folded into halves so that the bottom gusset portion 32 and the auxiliary gusset portions 33 can be formed by the sheet of bottom gusset material. The sheet of bottom gusset material is then supplied and interposed between the layers of panel material 11 to extend widthwise of the webs of panel material 11 by the bottom gusset material supply means, whenever the webs of panel material 11 are fed intermittently, so that the sheet of bottom gusset material can be combined with the sheets of side gusset material 14. For example, the upper layer of the panel material 11 is temporarily fixed to the sheets of the side gusset material 14 after the triangular flaps 25 are formed by ones of opposite end portions of the sheets of the side gusset material 14 and the webs of panel material 11 are superposed into two layers and whenever the webs of panel material 11 are fed intermittently. A Thomson blade is then pressed against the upper layer of panel material 11 so that the upper layer of panel material 11 can be cut widthwise of the webs of panel material 11 at the positions of the other end portions of the sheets of side gusset material 14 to form an opening of panel material 11. The sheet of bottom gusset material is inserted between the layers of panel material 11 through the opening of panel material 11 to extend widthwise of the webs of panel material 11 so that the sheet of bottom gusset material can be combined with the sheets of side gusset material 14 at the positions of the other end portions of the sheets of side gusset material 14.

The layers of panel material 11 are then heat sealed with the sheets of side gusset material 14 longitudinally of the webs of panel material 11 by longitudinal seal means so that longitudinal sealed portions 27 can be formed longitudinally of the webs of panel material 11. In addition, the layers of panel material 11 are heat sealed with the sheet of bottom gusset material widthwise of the webs of panel material 11 by cross seal means so that cross sealed portions can be formed widthwise of the webs of panel material 11. The layers of panel material 11 are then cut widthwise of the webs of panel material 11 by a cutter. The plastic bag therefore includes the side gusset portions 5 formed by the sheets of side gusset material 14, and the bottom gusset portion 32 and the auxiliary gusset portion 33 formed by the sheet of bottom gusset material, which are incorporated into the layers of panel portion 4 formed by the webs of panel material 11. The plastic bag further includes the side edges 3 formed by the longitudinal sealed portions 27 and the bottom edge 2 formed by the cross sealed portions.

The invention claimed is:

1. An apparatus for successively making plastic bags each of which includes side gusset portions incorporated into superposed two layers of panel portion, the apparatus comprising:

a panel material feeder by which webs of panel material are superposed into two layers and fed longitudinally thereof;

a side gusset material supplier by which webs of side gusset material are folded into halves and supplied onto one of the webs of panel material before the webs of panel material are superposed into the two layers to extend longitudinally of the webs of panel material, the webs of side gusset material being spaced from and opposed to each other widthwise of the webs of panel material, the webs of side gusset material being divided into sheets of side gusset material each of which has a length, the sheets of side gusset material being spaced from each other longitudinally of the webs of panel material before the webs of panel material are superposed into the two layers, the sheets of side gusset material being interposed between the layers of panel material when the webs of panel material are superposed into the two layers;

a temporary fixer by which the sheets of side gusset material and one of the webs of panel material are temporarily fixed to each other before the webs of panel material are superposed into the two layers; and a longitudinal sealer by which the layers of panel material are heat sealed with the sheets of side gusset material longitudinally of the webs of panel material after the sheets of side gusset material are interposed so that longitudinal sealed portions can be formed longitudinally of the webs of panel material, the plastic bag including the side gusset portions formed by the sheets of side gusset material and incorporated into the layers of panel portion formed by the webs of panel material, the plastic bag further including side edges formed by the longitudinal sealed portions.

2. The apparatus as set forth in claim 1 wherein the webs of side gusset material are divided into the sheets of side gusset material after being supplied.

3. The apparatus as set forth in claim 1 wherein the webs of side gusset material are divided into the sheets of side gusset material before being supplied, the webs of side gusset material being then supplied onto one of the webs of panel material in the form of the sheets of side gusset material.

4. The apparatus as set forth in claim 1 further comprising:

a zipper supplier by which a sheet of zipper material is supplied onto one of the webs of panel material before the webs of panel material are superposed into the two layers to extend widthwise of the webs of panel material so that the sheet of zipper material can be disposed between the sheets of side gusset material, the sheet of zipper material being interposed between the layers of panel material when the webs of panel material are superposed into two layers; and a cross sealer by which the layers of panel material are heat sealed with the sheet of zipper material widthwise of the webs of panel material after the sheets of side gusset material and the sheet of zipper material are interposed, the plastic bag including a zipper portion formed by the sheet of zipper material.

5. The apparatus as set forth in claim 4 further comprising:

the cross sealer by which the layers of panel material are heat sealed with each other widthwise of the webs of panel material after the sheets of side gusset material and the sheet of zipper material are interposed form a cross sealed portion widthwise of the webs of panel material, the plastic bag including a top edge formed by the cross sealed portion.

6. The apparatus as set forth in claim 1 further comprising:

a cutter by which the layers of panel material are cut widthwise of the webs of panel material after being heat sealed.

* * * * *